US005675301A

United States Patent [19]

Näppäet al.

[11] Patent Number: 5,675,301

[45] Date of Patent: Oct. 7, 1997

[54] DIELECTRIC FILTER HAVING RESONATORS ALIGNED TO EFFECT ZEROS OF THE FREQUENCY RESPONSE

[75] Inventors: Pauli Näppä; Jouni Ala-Kojola, both of Kempele, Finland

[73] Assignee: LK Products Oy, Kempele, Finland

[21] Appl. No.: 447,647

[22] Filed: May 23, 1995

[30] Foreign Application Priority Data

May 26, 1994 [FI] Finland ..... 942464

[51] Int. Cl.[6] ..... H01P 1/20

[52] U.S. Cl. ..... 333/202; 333/206

[58] Field of Search ..... 333/202, 203, 333/206, 222, 202 DB

[56] References Cited

U.S. PATENT DOCUMENTS 5,191,305 3/1993 Frost et al. ..... 333/202

FOREIGN PATENT DOCUMENTS 0 068 504 5/1983 European Pat. Off. ..... H01P 1/205
0 166 809 10/1984 Italy ..... H01P 1/205
57-148402 9/1982 Japan ..... H01P 1/205
58-053201 3/1983 Japan ..... H01P 1/205
58-075902 5/1983 Japan ..... H01P 1/205
63-283201 11/1988 Japan ..... H01P 1/205
633102 11/1978 U.S.S.R. ..... 333/203

*Primary Examiner*—Benny Lee
*Attorney, Agent, or Firm*—Darby & Darby

[57] ABSTRACT

A dielectric filter advantageously comprises a body of a dielectric material rectangular in cross-section and confining at least two parallel holes (31', 32', 33') that extend through the body parallel to each other and parallel to the side surface (34) plane. Major portions of the body are coated with a conductive material which also covers the inner surfaces of the holes (31', 32', 33'), hence forming a transmission line resonator for each hole. The resonators may be quarter-wave or half-wave resonators. According to the invention, the holes are located on at least two lines in the long direction of the body in which case the center axis of at least one hole (32') is not located on the same plane parallel to the side surface (34) as the center axes of the rest of the holes. Advantageously, the distance (D) of the center axis of a hole from the center axis of an adjacent hole is identical for all holes. In this manner it is possible to manufacture a filter that has a smaller volume than a filter with identical electrical characteristics having all the holes on one line.

2 Claims, 2 Drawing Sheets

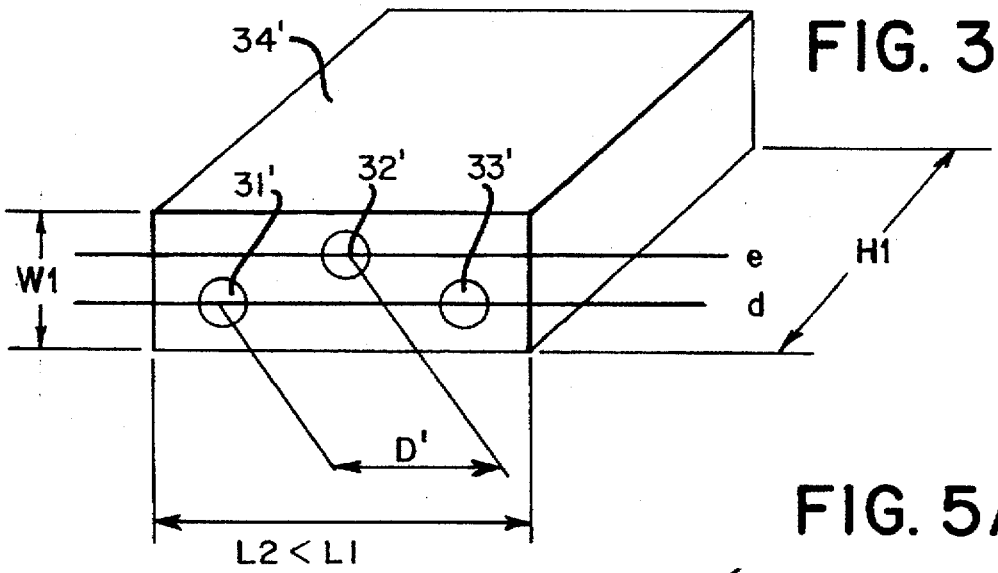
FIG. 3B
FIG. 5A
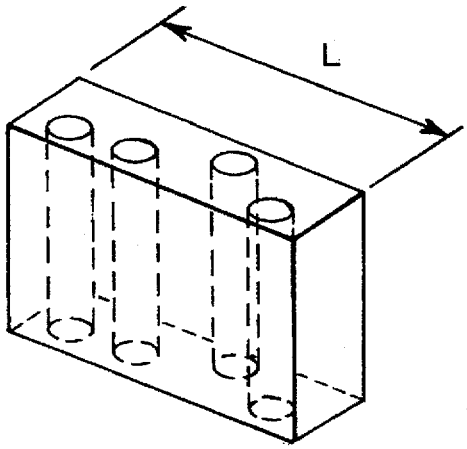
FIG. 4A
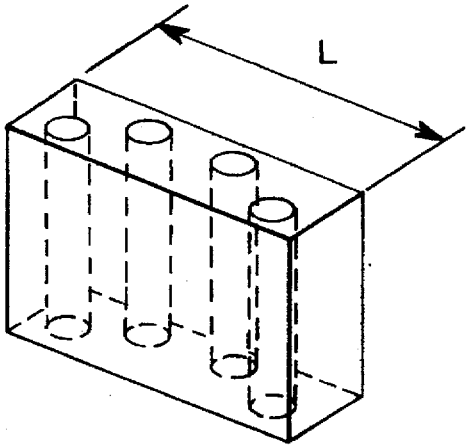
FIG. 5B
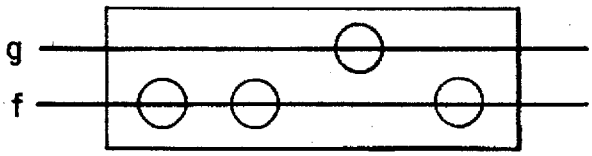
FIG. 4B
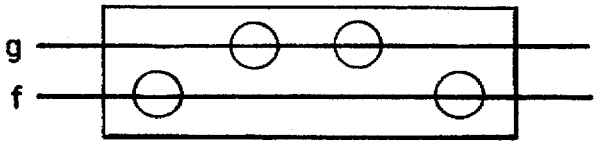

DIELECTRIC FILTER HAVING RESONATORS ALIGNED TO EFFECT ZEROS OF THE FREQUENCY RESPONSE

BACKGROUND OF THE INVENTION

This invention relates to a radio frequency filter implemented with transmission line resonators. The invention is particularly related to those filters comprising a body of a dielectric material with a first surface and a second surface at the opposite sides of the body, end surfaces, and side surfaces opposite to each other, said body confining at least two parallel holes the center axes of which extend parallel to each other and parallel to the side surface plane from the first surface toward the second surface. The inner surfaces of the holes are coated with a conductive material thereby forming a transmission line resonator for each hole.

It is known that conventional dielectric, usually ceramic, transmission line resonators consist of a block with an upper and lower surface at the opposite sides and side surfaces bordered by those surfaces. At least one hole coated with a conductive material extends from the upper surface of the block to the lower surface. Major portions of the surface of the block are coated with a conductive layer thus forming a transmission line resonator for each hole. As the conductive material of the coated hole is connected to the conductive material of the lower surface, the hole is short-circuited at that end. Since the upper surface surrounding the hole is not coated, the hole has an open circuit end at the top. In effect, such a block is a quarter-wavelength coaxial transmission line resonator where the coated hole corresponds to an inner conductor, the conductive coating of the block corresponds to an outer conductor, and in between there is an insulator of a dielectric material. Introducing an electromagnetic wave into the block results in a stationary wave at a certain frequency, i.e. the resonant frequency, in the direction of the hole. Its capacitive field maximum is at the open circuit end of the hole, and the inductive field maximum is at the short-circuited end of the hole.

A radio-frequency filter can be constructed using separate pieces, i.e. separate resonators, thus forming a separate resonator filter construction, or by using one ceramic block with several holes, in which case the ceramic block is common to the transmission line resonators.

FIGS. 1A and 1B illustrate a known basic form which will be called the first basic form. Filter 1 in FIG. 1A comprises three pieces 2, 3, and 4 which all are separate resonator pieces of the same shape. However, their height in the direction of the hole may vary according to the desired resonant frequency. Reference numbers 5, 6, and 7 refer to the holes extending through the pieces thereby forming resonators, as stated above. Darkened upper surface represents the uncoated area of the piece, while the rest of the surfaces are coated. Using a desired number of separate pieces it is possible to construct a filter with a desired number of stages. FIG. 1B is a top view of a filter. For the sake of simplicity, the resonator couplings are not shown in the figure. As can be seen, each hole 5, 6, 7 is located symmetrically in relation to the side surfaces of the piece and, hence, the mouths of the holes are all located on the line "a" drawn in the middle of the upper surface of the filter.

FIGS. 2A and 2B illustrate another known basic form which will be called the second basic form. FIG. 2A differs from FIG. 1A in that the filter body 21 comprises one single ceramic piece with holes 25, 26, and 27 in it. The upper surface represented by the darkened area is essentially uncoated while the rest of the surfaces (e.g. 28, 29) are coated. As can be seen from FIG. 2B, each hole 25, 26, 27, or inner conductor, is located on a plane parallel to the greater side surfaces 28 and 29 of the block and located between said side surfaces. Then the mouths of the holes are located on the line b drawn on the upper surface of the filter and parallel to the side surfaces 28 and 29. Line b can be at the same distance from both edges of the upper surface, in which case the construction is symmetrical, but that is not necessary. In a filter according to this basic form, the couplings between the resonators are made through an electromagnetic field and there is no need for external coupling elements as in the separate resonator construction.

The principal factor affecting the coupling of two adjacent resonator circuits in the filter construction according to the second basic form is the distance between the resonator holes, i.e. the distance between the inner conductors. If the body consists of one ceramic piece, the Q-factor of a resonator is slightly higher than that of a separate resonator of equal size because there are only two or three side walls susceptible to loss near the inner conductor of a resonator. Therefore, with this construction it is possible to implement a filter with electrical characteristics slightly better than those of separate resonators and, furthermore, due to its simple structure a single block filter is cheaper to manufacture in the case of mass-produced filters.

By disposing various conductive patterns on the uncoated upper surface of the block it is possible to affect the resonant frequency of a single resonator and the coupling between resonators. By placing a conductive pad next to the open circuit end of the outermost resonators of the block, insulated from the side coating, it is possible to couple a signal capacitively to the resonator and, likewise, to couple the signal capacitively from the resonator. There is a certain capacitance between the coating of the open circuit end of the resonator and the coating of the upper edge of the side of the ceramic block, and that capacitance can be changed by adding, on the upper surface near the hole, some coating which is connected to the coating on the side surface or by adding, on the upper surface, some coating which is connected to the coating of the hole. This affects the resonant frequency. Coupling between the resonators can also be controlled by arranging capacitors and transmission lines between the resonators by means of conductive patterns on the upper surface.

Inductive coupling between the resonators can be controlled by making modifications to the ceramic block, e.g. by drilling holes in it or otherwise removing material from it.

Use of dielectric filters in small portable radio equipment, particularly in cellular radiotelephones, results in an attempt to design filters with the dimensions and, above all, volume of which are as small as possible. This is a difficult task because both electrical and mechanical stability place restrictions on the miniaturization of filters. The electrical characteristics depend on the physical dimensions of the ceramic block and the manufacturing process of the block places restrictions on the stability.

The bottom surface area of a filter implemented with separate resonators is the total sum of the bottom surface areas of the resonators used. For example, when using 3*3*9 mm (9 mm is the length of the resonator hole) resonators in a triple-circuit band pass filter, the minimum bottom surface area is 9*9 mm. The filter is in this case in a horizontal position, i.e. the resonator holes are parallel to the mounting surface.

A simple way to decrease a filter's volume is to use as few resonator circuits as possible. In some applications, for example, it is possible to leave out some circuits from a four-circuit filter and compensate the missing circuits by making the rest of the circuits adjustable. Then a certain stop or pass band can be covered with a double or triple-circuit filter which has a narrower band but has a variable frequency level. A disadvantage is that variable filters require external control and a number of extra components.

Another simple way to decrease the filter volume would be to place the resonators, i.e. the holes, of a single-piece filter nearer to each other. This, however, would cause the coupling between the resonators to increase too much, which is not always desirable.

SUMMARY OF THE INVENTION

The present invention provides a simple way to decrease the total physical volume of a filter in a way such that the coupling of adjacent circuits remains approximately the same. In one aspect, the invention is characterized in that the center axes of the inner conductors of the resonators are located on only two planes parallel to the side surface of the resonator block. At least one inner conductor is displaced from the plane of the other inner conductors and, hence, its open circuit end is not on the same line with the open circuit ends of the other inner conductors.

In prior art ceramic filters the center axes of the inner conductors of the resonators are located on the same plane. That plane is the cross-section plane parallel to the greater side surface of the filter and is located between the greater side surfaces opposite to each other. Advantageously, but not necessarily, it is the plane of symmetry. According to this aspect of the invention, the holes that constitute the inner conductors of the resonators are positioned asymmetrically so that they are located on two cross-section planes. When viewing the uncoated upper surface of the block, the mouths of the holes are on two lines.

It is known that the distance between two adjacent inner conductors located on different lines determines the coupling between those circuits. If required, the dimensioning may be chosen such that the coupling is the same as it would be if the inner conductors were all on the same line. Then the distance from one inner conductor to the next, across one inner conductor, is shorter and the coupling across one circuit is stronger. Thus, it is possible, by means of resonator inner conductor positioning, to have the zeroes of the frequency response of the filter at desired frequencies while at the same time keeping the couplings of adjacent resonant circuits approximately constant.

In accordance with another aspect of the invention, the center axes of the holes can be located on more than two planes parallel to the side surface.

BRIEF DESCRIPTION OF THE DRAWINGS

Exemplary preferred emdobiments of the invention are illustrated by the enclosed drawings where:

FIG. 3B illustrates a perspective view of a filter in accordance with the present invention;

FIG. 4 is an embodiment of the top and side view of a filter according to the invention, and FIG. 5 is another embodiment of the top and side view of the filter according to the invention.

DESCRIPTION OF THE PREFERRED EMBODIMENTS

Figure 1A:
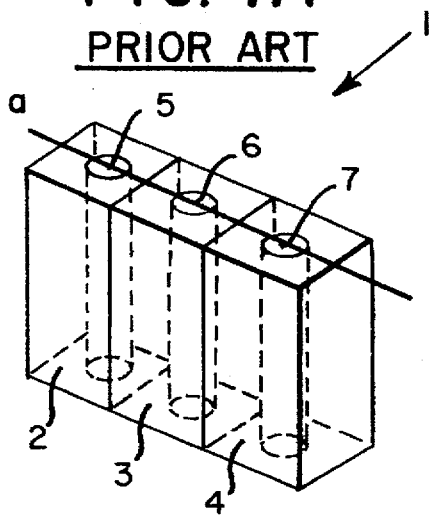
FIG. 1A PRIOR ART
FIG. 1A shows a prior art filter consisting of separate resonators.
Figure 1B:
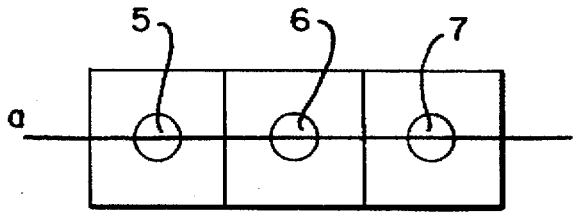
FIG. 1B PRIOR ART
FIG. 1B is a top view of the prior art filter shown in FIG. 1A.
Figure 2B:
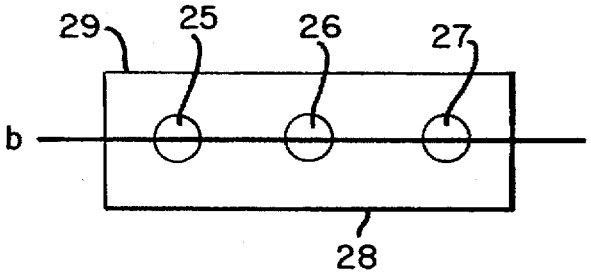
FIG. 2B PRIOR ART
FIG. 2B is a top view of the prior art filter shown in FIG. 2A.
Figure 2A:
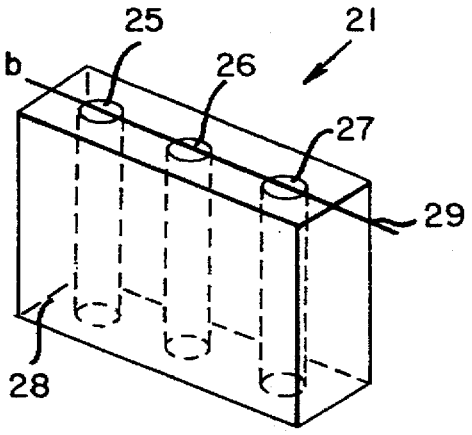
FIG. 2A PRIOR ART
FIG. 2A shows a prior art filter consisting of a single piece.
Figure 3A:
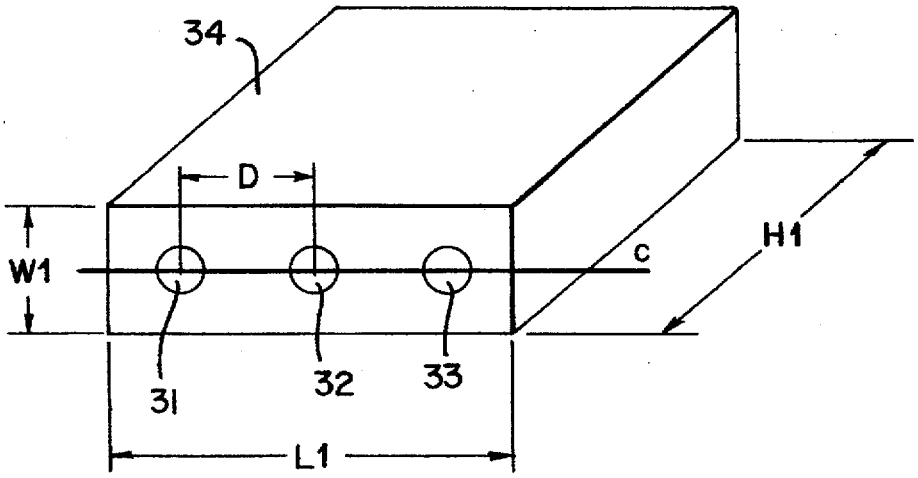
FIG. 3A PRIOR ART
FIG. 3A illustrates a perspective view of a prior art filter.

FIG. 3A is a top view of a prior art filter implemented in one piece. The open ends of the inner conductors of the transmission line resonators are on the uncoated upper surface of the block; in other words, holes 31, 32, and 33 extend through the block. The cross section of the upper surface and, hence, the filter is a rectangle the length of which is L1 and the width W1. The filter has three circuits. The resonator holes, i.e. the center axes of the inner conductors of the transmission line resonators are all on the same plane parallel to the side surface 34 and the plane divides the block into two—usually symmetrical—parts. The mouths of the holes are located on a line c crossing the upper surface parallel to its longer side, as shown in the drawing. The distances between the holes are equal and, hence, the distance between holes 31 and 32 is the same as the distance between holes 32 and 33; the distance is marked with D in the drawing. This distance together with the width W1 of the block are the most important factors determining the strength of the coupling between the resonators.

FIG. 3B is basically the same as 3A and uses, where applicable, the same reference numbers. The dimensioning is such that the electrical characteristics of the filter are approximately the same as those of the filter in FIG. 3A, thus better illustrating the advantages of the invention over prior art filters. The width of the dielectric block is still W1. According to the invention, holes 31 and 33 (FIG. 3A) have been moved a little towards a side surface 34', while hole 32 has been moved towards the opposite side surface. Therefore, holes 31' and 33' are located on the plane D parallel to the side surface, while hole 32' has been moved from the plane of holes 31' and 33' and is located on the plane e. In this new construction the distance between adjacent holes is still the same as in FIG. 3A and, therefore, the distance between holes 31' and 32' is D and the distance between holes 32' and 33' is D. Then the coupling of adjacent resonators is approximately the same as in the case illustrated by FIG. 3A. Naturally, the distance between the holes is an arbitrary quantity.

Moving the inner conductor of one resonator to its side and keeping the distance between the resonators the same results in that the distance between the inner conductors of the outermost resonators, i.e. holes 31' and 33', becomes shorter. This leads to that the length L2 of the filter is shorter than the length L1 of the filter in FIG. 3A with the same characteristics and, thus, $L2 < L1$. Since the resonating frequencies are identical, the heights H1 of the blocks, FIGS. 3A and 3B, are also identical. Hence it follows that since $L2 < L1$, while the other dimensions remain unchanged, thus the filter of the present invention (FIG. 3B) has a smaller volume than prior art filters (FIG. 3A), therefore requiring less space.

In addition to making the volume smaller, the configuration according to the invention makes it possible to control an electromagnetic coupling across one or more resonators creating one or more zeroes in the filter's frequency response. Note that the distance between the adjacent inner conductors is the same in both FIGS. 3A and 3B. The distance between the outermost resonators is shorter in the construction according to the invention than in prior art constructions which results in that the coupling across one circuit—in the drawing, the coupling between the outermost resonators—is stronger. Then it is possible to implement the frequency response zeroes created by the filter construction at desired frequencies by means of appropriate dimensioning of the inner conductors of the resonators while at the same time keeping the couplings of adjacent circuits approximately constant.

The Q-factors of the resonators of a filter according to FIG. 3B are somewhat lower than what can be obtained with a known construction according to FIG. 3A. The Q-factors are, however, higher than what can be obtained with corresponding separate resonators. The decrease in the Q-factor is therefore not significant and with the construction according to the invention it is possible to realize, in a manner according to the implementation of a traditional single-piece ceramic block, a filter having slightly better electrical characteristics than that implemented with separate resonators. In many cases, however, the reduction of the volume is such an important improvement that a small decrease of the Q-factor can be allowed.

FIGS. 4 and 5, in which the upper drawing is a perspective of a filter and the lower is a view of the end with the mouths of the holes, illustrate some of the possible inner conductor layouts in a four-circuit filter. The holes are located on two planes f and g. Compared to a prior art filter with identical electrical characteristics, the physical width L of the filter is smaller.

The examples illustrated above deal mainly with filters implemented with quarter-wavelength line transmission resonators. The claims, however, place no restrictions on the resonators and they may as well be half-wave resonators formed by short-circuiting the resonators at both ends, i.e. connecting the coating of the hole to the coating of the body, or by leaving the ends of the resonators open in which case the coating of the holes is not connected to the coating of the body.

The term 'single band' as applied to filters herein includes those band-pass or band-stop filters which carry out their respective filtering functions over a single continuous frequency range. This term does not include band-pass or band-stop filters which carry out their filtering function over a number of different frequency ranges, for example, so-called multiple band-pass filters.

We claim:

1. A radio frequency filter comprising:

a dielectric block having a first end and a second end, the dielectric block having an outer surface extending between the first end and the second end, and the outer surface having a coating of an electrically conductive material disposed thereon;

at least two holes disposed in the first end of said dielectric block, each said hole defining a respective line extending through the open end of each of the at least two holes as a first axis, the at least two holes respectively having an inner surface portion extending from the first end toward the second end and having a coating of the electrically conductive material disposed thereon to define respective transmission line resonators; and at least one hole disposed in the first end between the at least two holes, each said at least one hole defining a respective line extending through the open end of the at least one hole as a second axis substantially parallel to the first axis, the at least one hole having an inner surface portion extending from the first end toward the second end and having a coating of the electrically conductive material to define another transmission line resonator, the first and second axis being spaced a predetermined distance from each other so that adjacent resonators are spaced an equal distance from one another and the spacing between non-adjacent resonators is determinative of the frequency response of the zeros in the frequency response of the filter.

2. A radio frequency filter as recited in claim 1, wherein the at least one hole formed in the first end on the second axis is equally spaced from the at least two holes disposed on the first axis.

* * * * *